United States Patent [19]

Wright

[11] Patent Number: 4,531,728

[45] Date of Patent: Jul. 30, 1985

[54] DUMBBELL-LIKE ADD-ON WEIGHT FOR CONVENTIONAL WEIGHT EQUIPMENT

[75] Inventor: Gregory L. Wright, Lee's Summit, Mo.

[73] Assignee: Wright/LeChien Enterprises, Inc., Lee's Summit, Mo.

[21] Appl. No.: 637,550

[22] Filed: Aug. 3, 1984

[51] Int. Cl.[3] ..... A63B 11/00

[52] U.S. Cl. ..... 272/122; 272/116; 272/117; 272/143

[58] Field of Search ..... 272/122, 123, 116, 117, 272/143, 93, 67, 68, 96, 127

[56] References Cited

U.S. PATENT DOCUMENTS 4,029,312 6/1977 Wright ..... 272/123

FOREIGN PATENT DOCUMENTS 1112170 11/1955 France ..... 222/68

OTHER PUBLICATIONS

Advertisement for "Super Shoulder Pads" in The Sporting Goods Dealer, Aug./1983.

*Primary Examiner*—Richard J. Apley
*Assistant Examiner*—Robert W. Bahr
*Attorney, Agent, or Firm*—Schmidt, Johnson, Hovey & Williams

[57] ABSTRACT

Add-on type weight training devices which are designed for use with conventional barbell weight equipment, particularly in connection with specialized weight training regimes where successive, lighter weight loads are lifted until strength limits are reached. In preferred forms, the devices are provided in matched pairs, and each device includes an elongated (e.g. 4–18 inches), concavo-convex metallic gripping element with a pair of end-mounted, slotted, metallic plate-like weight members affixed to the gripping element. In use, the weight trainee positions the devices on the barbell inboard at the primary weights, with the gripping elements in direct enagement with the bar. In this fashion, the add-on devices and bar are simultaneously gripped for lifting purposes. When the trainee's strength limit is reached, the add-on devices are simply removed from the barbell and similar, lower weight add-on devices used in this same fashion.

16 Claims, 5 Drawing Figures

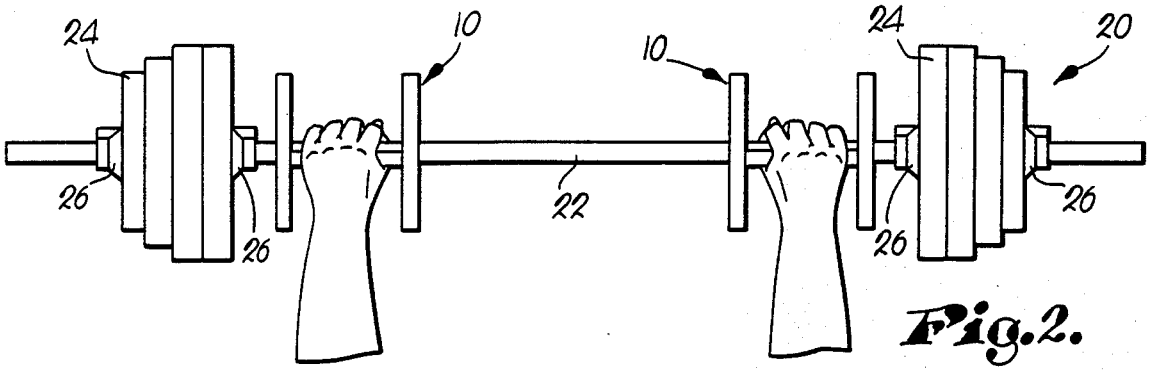
Fig.2.
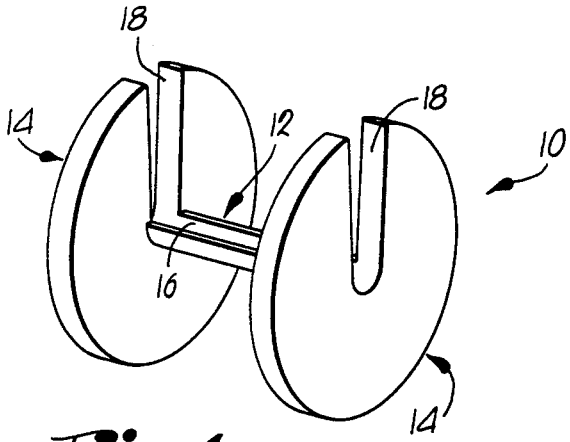
Fig.1.
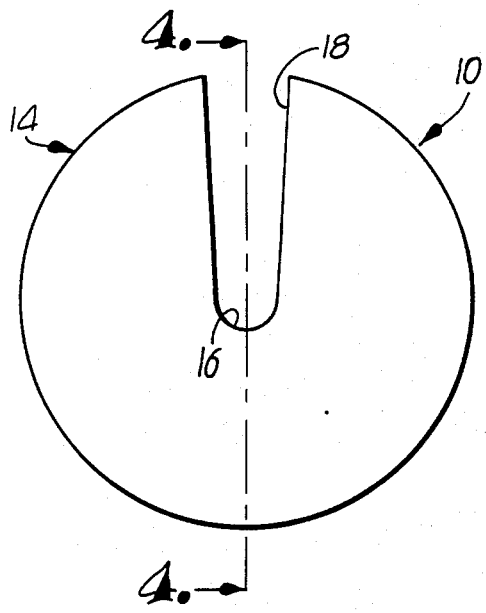
Fig.3.
Fig.4.
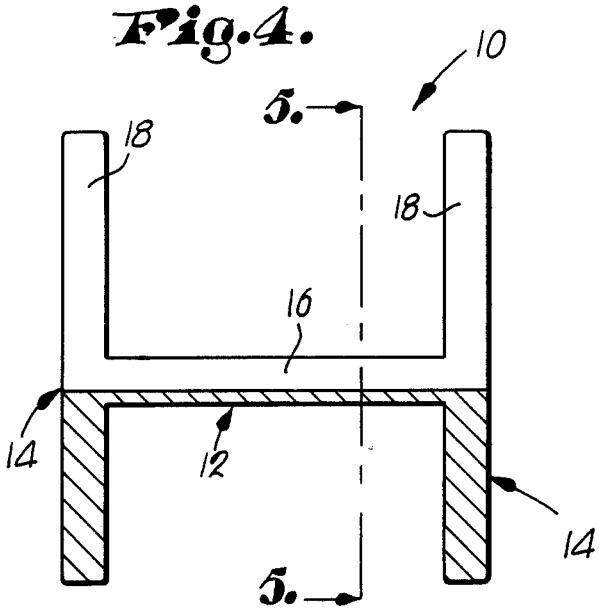
Fig.5.
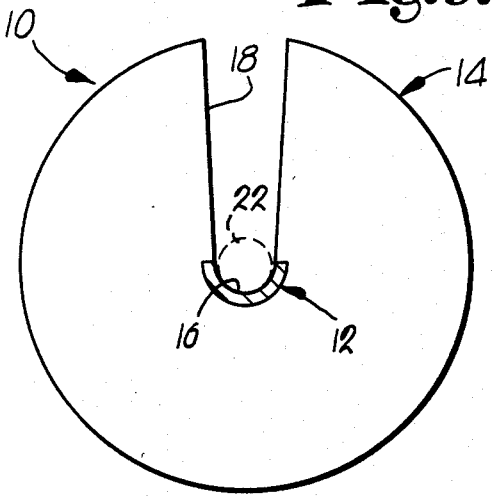

DUMBBELL-LIKE ADD-ON WEIGHT FOR CONVENTIONAL WEIGHT EQUIPMENT

BACKGROUND OF THE INVENTION

1. Field of the Invention

The present invention is broadly concerned with add-on weight training devices designed for use with conventional barbell weight equipment, in order to permit a weight trainee to engage in specialized weight training regimes without the necessity of having attendants nearby for purposes of changing weights. More particularly, it is concerned with such add-on weight training devices, as well as corresponding weight training methods, wherein the devices preferably include elongated, concavo-convex gripping elements, along with end-mounted plate-like, slotted weights which can be removably positioned on a barbell and held in place by simply simultaneously gripping both the barbell and devices.

2. Description of the Prior Art

It has long been the practice among weight training enthusiasts to conduct their training using barbell equipment. Generally speaking, such equipment includes an elongated cylindrical metallic bar, along with circular, plate-like weights removably positioned adjacent the opposed ends of the bar. A variety of lifts can be performed using such equipment, and for this purpose the trainee can either be standing or, for example, lying in a supine position on a weight training bench.

In recent years a weight training regime has been developed wherein the lifter will initially lift a relatively heavy load for a number of repetitions, until his strength limit is reached. Thereafter, the weight load on the barbell equipment is reduced, and the procedure is repeated until the next strength limit is reached. Thus, successive, lighter weight loads are lifted throughout the session.

While this type of weight training has a number of advantages for the lifter, it presents practical difficulties. To give but one example, if the lifter is lying in a supine position during this regime, at least one and perhaps two attendants are required to remove weights from the barbell as the successive strength limits are reached. As a consequence, it is virtually impossible for the weight trainee to perform the above-described type of specialized weight training when he is alone.

Various types of barbell equiment for use by weight trainees have been described in the past. For example, U.S. Pat. Nos. 3,771,785, 3,825,253, 3,913,908 and D-230,752 depict and describe a barbell arrangement wherein slotted plate weights are provided which facilitate installation and removal of these primary barbell weights. In addition, U.S. Pat. Nos. 1,672,944, 1,779,594 and 4,076,236 illustrate further types of specialized weight equipment.

SUMMARY OF THE INVENTION

The above noted problems are largely solved by the present invention which provides an add-on weight training device for use with conventional barbell equipment. Broadly speaking, the add-on devices of the invention include an elongated gripping element presenting a generally concave bar-engaging surface extending along the length thereof, with a pair of weight members respectively secured adjacent the opposed ends of the gripping element. Each of the weight members includes structure defining a slot extending from the periphery thereof to the element. The slots are configured and arranged for receiving a barbell bar and permitting placement of the device on the bar with the concave bar-engaging surface in direct contact with the bar.

In preferred forms, the elongated gripping element is of concavo-convex cross-sectional configuration, with the slots each being in communication with the concavity presented by the element 12. The latter is advantageously from about 4 to 18 inches in length. The weight members 14 are circular in end elevation, with the slots extending generally radially inwardly from the peripheries of the members toward the concavo-convex gripping element. However, the members may be polygonal with rounded corners.

The present invention also comprehends an improved weight training method wherein the trainee positions a pair of the add-on weight devices on a barbell bar in spaced relationship to one another and inboard of the primary barbell weights. Both of the devices are then gripped with the barbell bar, whereupon repeated lifts are completed until the trainee's strength limit is reached. At this point the lifter simply releases his grasp of the barbell bar, and removes the add-on devices from the bar. Next, a matched pair of lower weight add-on devices are positioned on the barbell bar, in exactly the same manner as heretofore described, whereupon further series of lifts are completed until the trainee's strength limit is again reached. This process of repeated lifts using fewer add-on weights is continued throughout the entire weight training session. It will be understood, of course, that this can be accomplished without the need for attendants or helpers who have therefore been required for removing weights from the barbell apparatus.

BRIEF DESCRIPTION OF THE DRAWING

FIG. 1 is a perspective view of a preferred add-on weight training device made in accordance with the invention;

FIG. 2 is an elevational view depicting a weight trainee using a pair of the add-on training devices of the invention, the latter being operatively positioned on a conventional barbell inboard of the primary barbell weights;

FIG. 3 is an end elevational view of the device depicted in FIG. 1, illustrating the configuration of one of the slotted plate-like weight members;

FIG. 4 is a view in partial vertical section taken along line 4—4 of FIG. 3 and further depicting the construction of the preferred weight training device; and FIG. 5 is a sectional view taken along line 5—5 of FIG. 4, with a barbell bar being illustrated in phantom and in engagement with the concavo-convex gripping element of the device.

DESCRIPTION OF THE PREFERRED EMBODIMENT

An add-on weight training device 10 is depicted in FIGS. 1 and 3–5. The device 10 includes an elongated (preferably from about 4 to 18 inches in length), concavo-convex gripping element 12, along with a pair of plate-like, slotted, weight members 14 fixedly secured to the element 12, all of which may be made from metal or other suitable material.

As best seen in FIGS. 4 and 5, the element 12 is of relatively thin configuration, and presents an upwardly facing concave face 16 which is adapted to complementally engage a cylindrical barbell bar in a manner to be described.

The weight members 14 are substantially identical and each is provided with an elongated, generally radially extending slot 18 which extends from the periphery of the member to a point adjacent the center thereof wherein the respective slots 18 communicate with the concavity presented by the element 12. It will further be noted in this respect that the diameter of the slots 18 gradually decrease from the periphery toward the element 12; moreover, the slots 18 are aligned with one another so as to facilitate mounting of the device on a conventional barbell bar.

The members 14 may be permanently affixed to the ends of the element 12, and for this purpose the members may be welded or molded in place, or alternately the entire device 10 may be produced by using a casting procedure. Still further, the members 14 may be releasably attached to the element 12, rendering them interchangeable.

Attention is next directed to FIG. 2 which illustrates a conventional barbell apparatus 20. The latter includes an elongated, cylindrical metallic bar 22, along with one or more primary weights 24 removably positioned adjacent the opposed ends of the bar 22. To this end, conventional collar structure 26 is provided in order to hold the primary weights 24 on the bar 22.

As further depicted in FIG. 2, a pair of add-on devices 10 are positioned inboard of the primary weights 24 such that the concave faces 16 of the respective elements 12 are in direct engagement with bar 22. In practice, the devices 10 are positioned by passing bar 22 through the respective slots 18, until the faces 16 of the elements 12 come into engagement with the bar 22. At this point, the user grasps both the bar 22 and the respective elements 12 in order to hold the elements in place on the bar, whereupon the entire assembly may be lifted in the same manner as the apparatus 20. The lifter then repeatedly lifts the entire assembly until his strength limit is reached. Next, the lifter simply releases his grasp of the bar 22 while holding the elements 10. The latter may then be removed from the bar 22 merely by passing the latter out through the aligned slots 18. The lifter can then drop the devices 10 and pick up another matched set thereof (which typically would be of a lesser weight), whereupon this second set is used in a manner identical to that described above.

It will therefore be seen that the present invention provides a greatly improved device for weight training enthusiasts, along with an improved method of carrying out weight training regimes.

I claim:

1. An add-on weight training device for use with a conventional barbell having an elongated bar and weights mounted adjacent the opposed ends of the bar, said add-on device comprising:

an elongated gripping element presenting a generally concave bar-engaging surface extending along the length thereof; and a pair of weight members having sufficient weight for use in weight training exercise respectively carried by said element adjacent the opposed ends thereof, each of said members including structure defining a slot extending from the periphery thereof to said element, said slots being configured and arranged for receiving said bar and permitting placement of said device on the bar with said bar-engaging surface contacting the bar.

2. The device of claim 1, said gripping element being of concavo-convex cross-sectional configuration, said slot each being in communication with the concavity presented by the element.

3. The device of claim 1, said element being from about 4 to 18 inches in length.

4. The device of claim 1, said weight members being permanently secured to said element.

5. The device of claim 1, each of said members being generally circular in end elevation, said slots extending generally radially inwardly from the peripheries of the members.

6. The device of claim 1, the diameter of said slots gradually decreasing from the periphery of the members towards said element.

7. In combination:

a barbell including an elongated, cylindrical bar, and weights secured adjacent the opposed ends of the bar;

a pair of add-on weight devices having sufficient weight for use in weight training exercise each including an elongated gripping element configured for complementally engaging said bar, said devices each being configured for placement of the elements thereof in direct engagement with said bar and being releasably maintained in such engagement by the hands of a weight trainee gripping both the respective elements and the bar.

8. The combination of claim 7, each of said devices including a pair of weight members respectively secured adjacent the opposed ends of the gripping element.

9. The combination of claim 8, each of said weight members including structure defining a slot extending from the periphery thereof to said element, said slots being configured and arranged for receiving said bar and permitting placement of the devices on the bar with the gripping elements in engagement with the bar.

10. The combination of claim 9, each of said members being generally circular in end elevation, said slots extending generally radially inwardly from the peripheries of the members.

11. The combination of claim 10, the diameter of said slots gradually decreasing from the periphery of the members towards said element.

12. The combination of claim 7, each of said gripping elements being of concavo-convex cross-sectional configuration, said slots each being in communication with the concavity presented by the associated element.

13. The combination of claim 7, each of said elements being from about 4 to 18 inches in length.

14. In a weight training method wherein a weight trainee grasps a barbell and successively lifts the same, said barbell including an elongated bar with weights affixed adjacent the opposed ends thereof, the improved method including the steps of:

positioning a pair of add-on weight training devices having sufficient weight for use in weight training exercise on said bar in spaced relationship with one another and inboard said barbell weights;

gripping both of said devices and said bar; and lifting both said barbell and said devices together.

15. The method of claim 14, including the step of holding said devices against said bar only by said gripping step.

16. The method of claim 14, including the step of repeatedly performing said lifting step, thereafter removing said devices from the bar, then positioning a second, lighter weight pair of devices on said bar, and repeating said lifting step.

* * * * *